United States Patent [19]

Nakahara et al.

[11] Patent Number: 4,565,764

[45] Date of Patent: Jan. 21, 1986

[54] MICROCAPSULE TONER AND PROCESS OF MAKING SAME

[75] Inventors: Toshiaki Nakahara; Ichiro Ohsaki, both of Kawasaki; Hisayuki Ushiyama, Hiratsuka, all of Japan

[73] Assignee: Canon Kabushiki Kaisha, Tokyo, Japan

[21] Appl. No.: 527,395

[22] Filed: Aug. 29, 1983

[30] Foreign Application Priority Data

| | | | |
|---|---|---|---|
| Sep. 10, 1982 | [JP] | Japan | 57-158360 |
| Sep. 13, 1982 | [JP] | Japan | 57-160155 |
| Nov. 4, 1982 | [JP] | Japan | 57-194361 |

[51] Int. Cl.[4] ..... G03G 9/16

[52] U.S. Cl. ..... 430/111; 430/137; 430/138; 428/402.2; 427/213.36; 346/200

[58] Field of Search ..... 430/111, 138; 428/402.2; 282/27.5

[56] References Cited

U.S. PATENT DOCUMENTS

| | | | |
|---|---|---|---|
| 3,080,251 | 3/1963 | Claus | 430/138 X |
| 3,190,837 | 6/1965 | Brynko | 428/402.22 X |
| 3,551,346 | 12/1970 | Breen et al. | 428/402.24 X |
| 3,627,693 | 12/1971 | Scarpelli | 428/402.24 X |
| 3,788,994 | 1/1974 | Wellman et al. | 430/111 |
| 3,844,816 | 10/1974 | Vassiliades | 428/402.24 X |
| 3,860,565 | 1/1975 | Barber | 528/44 X |
| 3,893,933 | 7/1975 | Brown | 428/402.24 X |
| 4,121,931 | 10/1978 | Nelson | 430/110 |
| 4,356,245 | 10/1982 | Hosono et al. | 430/122 |
| 4,395,476 | 7/1983 | Kanbe et al. | 430/102 |

FOREIGN PATENT DOCUMENTS

| | | |
|---|---|---|
| 0002119 | 6/1979 | European Pat. Off. . |
| 2704361 | 7/1979 | Fed. Rep. of Germany . |
| 132838 | 7/1976 | Japan . |

*Primary Examiner*—John D. Welsh

*Attorney, Agent, or Firm*—Fitzpatrick, Cella, Harper & Scinto

[57] ABSTRACT

A microcapsule toner having a colored core material coated successively with a first resin wall and a second resin wall can be provided with both excellent pressure fixing characteristic and physical stability when the first resin wall has affinity to both the core material and the second resin wall, and can suitably be used for electrophotography, electrostatic printing, etc.

9 Claims, No Drawings

MICROCAPSULE TONER AND PROCESS OF MAKING SAME

BACKGROUND OF THE INVENTION

1. Field of the Invention

This invention relates to a microcapsule type toner to be used for electrophotography, electrostatic printing, magnetic recording and the like, and a process for producing the microcapsule toner.

2. Description of the Prior Art

In the prior art, as the toner for electrostatography, electrostatic printing or magnetic recording, use has been made primarily of resinous particles prepared by dispersing in a resin a dye or a pigment, and a magnetic material, if desired, followed by kneading and crushing into fine particles of about 5 to 30μ.

A toner for these processes is required to have a variety of performances, including developing characteristic, fixing characteristic, durability, stability, resistance to environmental conditions and others, and a single material can hardly satisfy all of these various performances. Accordingly, there has been proposed a so called microcapsule toner, in which the function related primarily to the surface of the toner particles such as developing characteristic is separated from the function related primarily to the bulk of the toner such as fixing characteristic, namely, one comprising a core material with good fixing characteristic enclosed within a material excellent in developing characteristic. Particularly, in recent years, a large number of machines utilizing the pressure fixing system have been reported, in which, in place of thermal fixing system, fixing is performed by pressing down a toner against a fixing substrate (mostly, plain paper). This pressure fixing system has a number of advantages: thus no or little, if any, heat source is required accompanying danger of fire as well as the risk of scorching of copied sheets, and the device can also be simplified. Also, no waiting time before heating of a fixer is necessary and thus adaptability for high speed copying is high.

As an example of such a microcapsule toner, there is a capsule toner containing a soft material as the core as discloed in Japanese Patent Publication No. 8104/1979 or a capsule toner containing a soft resin solution core as disclosed in Japanese Laid-open patent application No. 132838/1976.

However, microcapsule toners proposed heretofore still involve a large number of problems and are far from satisfactory in practical application. This may be partly because of the fact that a material suitable as the toner material is not necessarily suitable as the material for microcapsule, while it is difficult to impart suitable developing characteristics for a toner, particularly charge controlling characteristic, to a material for microcapsule, particularly a material constituting walls.

In an encapsulation process presently practiced frequently in the art, a solid core material is dispersed in a solution of a wall material for enclosing the core material therein, and the solvent is removed by heating or other means thereby to precipitate the wall material around the core material. This process has the advantage of availability of materials with desired characteristics in combination such as, for example, a material with excellent fixing characteristic and a material with excellent developing characteristic, but the combination of available materials is limited due to the use of a solvent. Also, even if one of the limited combinations is adopted, the core material cannot completely be insoluble in the solvent employed. Particularly, it is difficult to completely prevent a low molecular weight component, which is to be added intentionally for improvement of fixing characteristic, from being dissolved out into the solvent. As the result, there are involved problems that such as component dissolved out may interfere with adhesion of the wall material on the surface of the core material, and also that no sufficient functional separation is attained due to entrainment of the core material into the wall material, which have adverse effects on developing characteristic and durability.

Further, even a microcapsule toner having overcome the drawbacks as mentioned above still has a problem of peel-off of the wall material caused by the shocks during developing operations, and under the present situation, there remain a large number of problems to be solved before practical application of the microcapsule toner such as completeness in coating, toughness of coating, and also pressure fixability as the basic characteristic. More specifically, there has been obtained no practical pressure fixing toner, which has the characteristics of excellent pressure fixability without off-set phenomenon onto the pressure rollers, stable developing performance and fixing performance for repeated usage without adhesion to carrier, metal sleeve or the surface of a photosensitive member as well as good storage stability without agglomeration or caking during storage. In particular, there remains a problem with respect to the pressure fixing characteristics concerning the fixing characteristic onto plain paper. Furthermore, in the capsule toner as described above, the adhesive force between the core material and the wall material is weak, whereby peel-off of the wall may partly occur, thus frequently causing problems such as changes in image quality and image density due to increased triboelectric charges in continuous copying tests or fusion of the wall material onto a developing sleeve or the surface of a photosensitive member.

In addition to the above mentioned prior art, the research group to which we belong has developed a microcapsule toner having an outer shell layer comprising a cyclized rubber (U.S. Pat. No. 4,265,994). The microcapsule toner can take a double-layered wall structure having an insulating resin layer overlying the cyclized rubber layer. This double-wall microcapsule toner has, however, sometimes caused peeling-off of the insulating layer to cause contamination of equipments for development and fixation and result in somewhat poor quality of images after a long term of continuous copying operation.

SUMMARY OF THE INVENTION

An object of the present invention is to provide a microcapsule toner having solved the drawbacks as mentioned above.

Further, it is also an object of the present invention to provide a microcapsule toner which is high in completeness of coating, excellent in functional separation and excellent in durability without peel-off of the coating.

We have made researches with the above objects and consequently found that it is fundamentally difficult to satisfy a large number of toner characteristics required for electrophotography, electrostatography and magnetic recording, in addition to the pressure fixing characteristic, by a combination of a core material and a single wall material, but it is effective for the purpose to use a plurality of wall layers with the intermediate wall material having affinity with both the core material and the outer wall material.

The microcapsule toner of the present invention is based on such a finding and, more specifically, comprises a colored core material, a first resin wall coating the core material and comprising a material having affinity with the core material and a second resin wall coating the first resin wall and comprising a material having affinity with the first resin layer.

According to a preferred embodiment of the present invention, the first, intermediate resin wall is chemically bonded to at least the second, outer resin wall of the core material and the second resin wall.

According to another preferred embodiment of the present invention, the first resin wall constituting material comprises polyvinyl alcohol.

According to another aspect of the invention, there is provided an improvement in a process for producing a microcapsule toner comprising causing phase separation of a resin solution in an encapsulation medium of an organic solvent in the presence of core particles to form coacervate droplets, and causing the coacervate droplets to adhere onto the core particles to form resin walls enclosing the core particles, wherein the coacervate droplets have a charging polarity opposite to that of the core particles in the encapsulation medium.

The present invention will be described in further detail below. In the following description, "parts" and "%" used in relation to composition are by weight unless otherwise noted specifically.

DESCRIPTION OF THE PREFERRED EMBODIMENTS

As the binder resin in the core material constituting the microcapsule toner of the present invention for use as a pressure fixing toner, there may be employed waxes such as polyethylene wax, polyethylene oxide, fatty acid, fatty acid ester, fatty acid amide, fatty acid metal salt, higher alcohol, etc.; ethylene-vinyl acetate resin; and cyclized rubber. Among them, it is preferred to use a binder mainly composed of polyethylene of a density of 0.94 g/cm$^3$ or higher or a paraffin wax.

As the polyethylene having a density of 0.94 g/cm$^3$ or higher, particularly preferably are those having a melt viscosity at 140° C. of 600 CPS (centipoises) or lower, which are known as the so called low molecular weight polyethylene or polyethylene wax and can be produced by the polymerization method or the decomposition method. Commercially available polyethylene with melt viscosities of 600 CPS or lower and densities of 0.94 g/cm$^3$ or higher includes the following:

AC polyethylene #9 (produced by Allied Chemical Corp.) (0.94 g/cm$^3$, 350 CPS)

Hiwax 310 P (produced by Mitsui Sekiyu Kagaku K.K.) (0.94 g/cm$^3$, 250 CPS)

Hiwax 410 P (produced by Mitsui Sekiyu Kagaku K.K.) (0.94 g/cm$^3$, 550 CPS)

Hiwax 405 P (produced by Mitsui Sekiyu Kagaku K.K.) (0.96 g/cm$^3$, 550 CPS)

Hiwax 400 P (produced by Mitsui Sekiyu Kagaku K.K.) (0.97 g/cm$^3$, 550 CPS)

Those having melt viscosities of 150 CPS or lower and densities of 0.94 g/cm$^3$ or higher are exemplified below:

Hiwax 200 P (produced by Mitsui Sekiyu Kagaku K.K.) (0.97 g/cm$^3$, 70 CPS)

Hoechst Wax PE 130 (produced by Hoechst AG) (0.95 g/cm$^3$, 117 CPS)

As the paraffin wax, those as shown in the following Tables may be included.

TABLE 1

| Paraffin wax and Microwax (produced by Nippon Sekiyu K.K.) | |
|---|---|
| Trade Name | m.p. °C. |
| Nisseki No. 1 Candle wax | 59.7 |
| Nisseki No. 2 Candle wax | 62.0 |
| 125° Paraffin | 54.3 |
| 130° Paraffin | 56.5 |
| 135° Paraffin | 59.7 |
| 140° Paraffin | 61.9 |
| 145° Paraffin | 63.2 |
| 125° FD Paraffin | 53.8 |
| Paraffin wax (M) | 54.1 |
| 125° Special paraffin | 54.2 |
| Nisseki Microwax 155 | 70.0 |
| Nisseki Microwax 180 | 83.6 |

TABLE 2

| Paraffin wax (produced by Nippon Seiro K.K.) | | | | |
|---|---|---|---|---|
| Trade Name | m.p. °C. | Trade Name | m.p. °C. | Trade Name |
| 155 | 70 | SP-0145 | 62 | NCW-5 |
| 150 | 66 | SP-1035 | 58 | NCW-10 |
| 140 | 60 | SP-1030 | 56 | NCW-35 |
| 135 | 58 | SP-3040 | 63 | NCW-38 |
| 130 | 55 | SP-3035 | 60 | NCW-40 |
| 125 | 53 | SP-3030 | 57 | NCW-42 |
| 120 | 50 | FR-0120 | 50 | NCW-45 |
| 115 | 47 | | | NCW-50 |
| | | | | NCW-55 |
| | | | | NCW-60 |
| | | | | NCW-110 |
| | | | | NCW-120 |
| | | | | NCW-125 |

In the present invention, it is preferred to use a suitable combination of the polyethylene with a density of 0.94 g/cm$^3$ or above and paraffin wax. Of course, if necessary, several kinds of paraffin waxes may also be used in combination.

When the polyethylene and paraffin wax are used in combination, it is preferred to use them in a weight ratio of 8/2 to 1/9, particularly 6/4 to 2/8.

When the microcapsule toner of the present invention is to be used as a heat fixing toner, the binder resin in the core material may preferably include the following: thus, materials exhibiting rubber elasticity such as styrene-butadiene resins, polyester resins having three or more functional groups, resins having crosslinked portions between the main chains by containing carboxylic acid groups crosslinked with a metal or by copolymerization with a crosslinkable monomer. Such resins with three-dimensional network structures because of crosslinked portions are excellent in suppressing heat off-set when employing a heat roll fixer, and while the fixing temperature can be suppressed relatively lower by broadening the molecular weight distribution by mixing a low molecular weight component with these resins in a suitable amount, heat off-set property can still be improved.

As a resin constituting the core material of the present invention, other than the series of materials as mentioned above, a resin having functional groups reactive with a carboxylic acid choride may also be mixed. For example, polyvinyl alcohol or polyvinyl amine may be added in amounts of 0.1 to 20%, based on the total resin in the core material.

Into the core material of the capsule toner of the present invention, known dyes, pigments, etc. may be used as a colorant in addition to the binder resins as described above. Illustrative of such colorants are carbon black of various species, aniline black, naphthol yellow, molybdenum orange, rhodamine lake, alizarin lake, methyl violet lake, phthalocyanine blue, nigrosine methylene blue, rose bengal, quinoline yellow and others.

When the capsule toner of the present invention is used as a magnetic toner, magnetic powder may be incorporated in the core material. As magnetic powder, those of strongly magnetic elements such as iron, cobalt, nickel or manganese and alloys or compounds containing these elements such as magnetite, ferrite, etc. may be employed. The magnetic powder may also function as a colorant. The content of the magnetic powder may be 15 to 70 parts per 100 parts with respect to the total resin in the core material.

Also, in order to impart a free flowing property to the resultant microcapsule toner, or for any other purpose, it is possible to use colloidal silica, cerium oxide, a metal soap, etc. in addition to the above components.

For obtaining better performance in the microcapsule toner of the present invention, choice of the material constituting the first wall, namely the inner wall, is important.

According to a first preferred embodiment of the present invention, as mentioned above, the first resin wall exists under a state chemically bonded to at least the second resin wall, of the core material and the second resin wall. Such a state can be attained, for example, by reacting an olefinic carboxilic acid chloride with a core material in the presence of an acid eliminating agent (deacidification agent) to form the first wall, then epoxidizing through oxidation of the olefin to form the first resin wall and thereafter forming the second wall with a resin having tertiary amine units.

Olefinic carboxylic acid chlorides may be selected from, for example, a series of mono-carboxylic acid chlorides having one double bond. Examples of olefinic mono-carboxylic chlorides are acrylic acid chloride, crotonic acid chloride, isocrotonic acid chloride, vinyl acetic acid chloride, methacrylic acid chloride, angelic acid chloride, tiglic acid chloride, 2-pentenoic acid chloride, 3-pentenoic acid chloride, $\alpha$-ethylacrylic acid chloride, $\beta$-methylcrotonic acid chloride, 4-pentenoic acid chloride, 2-hexenoic acid chloride, 3-hexenoic acid chloride, 4-hexenoic acid chloride, 5-hexenoic acid chloride, 2-methyl-2-pentenoic acid chloride, 3-methyl-2-pentenoic acid chloride, 4-methyl-2-pentenoic acid chloride, $\alpha$-ethylcrotonic acid chloride, 2,2-dimethyl-3-butenoic acid chloride, 2-heptenoic acid chloride, 2-octenoic acid chloride and the like.

Other than olefinic mono-carboxylic acid chlorides, it is also possible to use a diolefinic mono-carboxylic acid chloride, an unsaturated dicarboxylic acid chloride, or the like.

An olefinic carboxylic acid chloride is soluble in an organic solvent such as an ether, and its concentration is adjusted to a range of 0.05 mol/liter or more, preferably from 0.1 to 0.5 mol/liter. It is preferred that the amount of the olefinic carboxylic acid chloride employed should be such that the amount of the olefinic moiety attached to the core material may be within a range from 0.1 to 20% of the core material.

The acid eliminating agent available may include organic bases such as triethylamine, pyridine, dimethylaniline and the like. The acid eliminating agent is dissolved in a dispersant for the core material and its concentration may be substantially equal to that of an olefinic mono-carboxylic acid chloride or a diolefinic mono-carboxylic acid chloride, when such a compound is to be employed, or equal to twice as much as the concentration of the acid chloride, when an olefinic dicarboxylic acid chloride is to be employed.

As the oxidizing agent to be used for oxidation of an olefin, peracids which are organic peroxides may be used. Typical examples are peracetic acid, perbenzoic acid and perbutyric acid. The organic peroxide is soluble in an organic solvent and may be used at a concentration within a range from 0.1 to 0.5 mol/liter.

The resin having tertiary amine units may be selected from the resins having necessary charge controlling characteristic and exhibiting reactivity with an epoxy compound at around normal temperature. In general, copolymers of a polymerizable monomer having a tertiary amine unit and other copolymerizable monomers may be used, including copolymers of dimethylaminoethyl methacrylate with styrene and copolymers of diethylaminoethyl methacrylate with styrene. The resin having tertiary amine units may be added in an amount of 1 to 20 parts per 100 parts of the core material.

According to a second preferred embodiment of the present invention, the first resin wall is constituted of polyvinyl alcohol.

The specific feature of this embodiment resides in a microcapsule type toner comprising a core material and an outer wall material, having a polyvinyl alcohol layer as an intermediate layer between the core material and the outer wall material.

Polyvinyl alcohol is a hydrolyzate of polyvinyl acetate with an alkali, referring generally to those with a saponification degree of 70% or more. Polyvinyl alcohol is a water-soluble polymer, which is crystalline and insoluble generally in organic solvents except for several amines or hot acetic acid, glycerine, acetamide and phenol. Polyvinyl alcohol has a good film forming property, is tough and has an excellent impact resistance as well as a high tensile strength, being also excellent in adhesion to ther resins. Moreover, polyvinyl alcohol, which has a hydrophobic ethylenic main chain and hydrophilic hydroxyl groups, has a surface activity, characterized by the property of adequately enclosing generally hydrophobic core materials and at the same time being wetted well with hydrophobic wall materials. Due to these various characteristics of polyvinyl alcohol, when a core material is first microencapsulated within polyvinyl alcohol, the core material can be protected against the solvent to be used in subsequent microencapsulation with a wall material, whereby no lowering of the function of the wall material when admixed with the core material occurs, and also wettability or adhesiveness of the wall material can be improved, thus providing a toner having a high impact resistance.

Polyvinyl alcohol commercially available and suitable for use has a saponificion degree of 88% to ca. 100% and a polymerization degree of 300 to 3000. The crystallinity is higher as the saponification degree is higher, and the water resistance can be obtained by heat treatment, and therefore polyvinyl alcohol with higher saponification degree is preferred. As for polymerization degree, around 1700 is suitable in view of easiness in handling when the polyvinyl alcohol is made into an aqueous solution.

As a method for encapsulation of a core material with polyvinyl alcohol, a method in which polyvinyl alcohol is gelled through the reaction with boric acid, borax or silicic acid such as clay or silica, or with copper ions under a basic condition, may be used. However, for easier control of encapsulation, it is preferred to use a method in which polyvinyl alcohol is dehydrated with an inorganic salt to cause phase separation.

Examples of the inorganic salt include $(NH_4)_2SO_4$, $Na_2SO_4$, $K_2SO_4$, $ZnSO_4$, $CuSO_4$, $FeSO_4$, $MgSO_4$, $Al_2(SO_4)_3$, $KAl(SO_4)_2$, $NH_4NO_3$, $NaNO_3$, $Al(NO_3)_3$, $KNO_3$, NaCl, KCl, $Na_3PO_4$, $K_2CrO_4$, $H_3BO_3$ and the like. Among them, ammonium sulfate and sodium sulfate are suitable.

The polyvinyl alcohol wall precipitated with an inorganic salt is insoluble in cold water as such, but it can be subjected to heat treatment thereby to be enhanced in degree of crystallization and improved in water resistance. As the heat treatment method, wet treatment by heating in an aqueous saturated ammonium sulfate solution at 140° to 160° C. or dry treatment by heating in air at 180° to 200° C., may be used.

As the method for providing the second wall for imparting developability to the microcapsule coated with polyvinyl alcohol, there may be employed any known microencapsulation method for coating of a solid core. Spray drying is simple but has a disadvantage that free wall materials are liable to be formed. Therefore, microencapsulation in a liquid medium is more suitable, such as phase separation method, drying-in-liquid method, melt-dispersion and cooling method, etc.

As the material for the second wall to be used in combination with the first wall comprising polyvinyl alcohol, resins known in the art are usable. Examples of the resins are homopolymers or copolymers of monomers such as styrene or its derivatives including styrene, p-chlorostyrene, p-dimethylaminostyrene, etc.; esters of acrylic acid or methacrylic acid such as methyl acrylate, ethyl acrylate, butyl acrylate, methyl methacrylate, ethyl methacrylate, butyl methacrylate, N,N-dimethylaminoethyl methacrylate and the like; maleic anhydride or half-ester, half-amide or diesterimide of maleic anhydride; nitrogen-containing vinyl monomers such as vinyl pyridine, and N-vinylimidazole; vinyl monomers such as vinyl chloride, acrylonitrile, and vinyl acetate; vinylidene monomers such as vinylidene chloride, and vinylidene fluoride; olefins resins such as ethylene, and propylene; and vinyl acetal resins such as vinyl formal resin and vinyl butyral resin; polyester; polycarbonate; polysulfonate; polyamide; polyurethane; polyurea; epoxy resin; rosin; modified rosin; terpene resin; phenol resin; aliphatic or alicyclic hydrocarbon resin; aromatic petroleum resin; melamine resin; polyether resin such as polyphenylene oxide; thioether resin; and so on. These resins may be used in mixture, as desired. Since the hydroxyl group of polyvinyl alcohol is reactive with aldehyde, acid chloride, isocyanate, etc., it is also possible to provide a second wall through the reaction with a substance having such a functional group.

As for the quantities defining the thicknesses of the microcapsule walls, the first polyvinyl alcohol wall may sufficiently be 10 to 12%, while the second wall 3 to 5% to exhibit inherent properties, both based on the core material.

According to a third preferred embodiment of the present invention, i.e. a preferred embodiment of the process for producing a microcapsule toner according to the invention, the first resin wall comprises a material having a charging characteristic of being charged to a polarity opposite to those of the core material and the second resin wall constituting material in encapsulation media for formation of the first resin wall and for formation of the second resin wall.

The polarity of each material in an encapsulating medium can be judged from an electrodeposition characteristic, i.e., on which electrode the material is electrodeposited when a dispersion of a core material, a first wall constituting resin, or a second wall constituting resin or a coacervate as its precursor in a medium is placed in a cell equipped with parallel flat plate electrodes and a direct current electric field is applied across the parallel flat plate electrodes.

The materials liable to be charged to ⊕ polarity include dimethylaminoethyl methacrylate polymers, vinyl pyridine polymers, acrylamide polymers, diethylaminoethyl methacrylate polymers and polyethylene, including copolymers of corresponding monomers with other monomers, although such tendency may differ on the encapsulation medium employed.

The materials liable to be charged to ⊖ polarity include vinyl chloride polymers, styrene polymers and acrylic acid polymers, including copolymers of corresponding monomers with other monomers.

As a preferable method for encapsulation according to the third preferred embodiment, a resin for formation of the first or the second capsule wall is dissolved in a good solvent, and a core material or a core material coated with the first wall is dispersed into the resultant solution by means of a stirrer such as three-one motor or homomixer. While stirring is continued, a poor solvent which is miscible with the solvent for the first or the second wall forming resin solution but does not dissolve these wall forming resins is added dropwise, thereby effecting phase separation of the wall forming resin as the coacervate droplets around the core material. Further, by continuing the dropwise addition of the poor solvent, the good solvent including a portion thereof contained in the coacervate droplets gathering around the core material is removed, thereby permitting the coacervate droplets to coalesce with each other, to form capsule walls. These operations are successively repeated to form the first wall and the second wall. After completion of encapsulation, the medium is removed by filtration or centrifuge, followed by drying on air or by means of a drier, and the product can be taken out as capsule powder.

These first to third preferred embodiments of the present invention can be combined, as desired.

The microencapsulated toner of the present invention thus obtained has a particle size generally in the range of from 5 to 20μ.

The microcapsule toner of this invention can further incorporate or be mixed with ingredients other than the respective components as described above, for the purpose of charge controlling, imparting free flowing property or dyeing, such as carbon black, various dyes or pigments, hydrophobic colloidal silica, etc.

The microcapsule toner of the present invention thus prepared can suitably be used as a pressure fixable toner in electrostatography including electrophotography and electrostatic printing or in magnetic recording.

The modes in which the toner of the present invention is utilized will further be discussed comprehensively, concerning the developing method for visualization of electrostatic images. They are broadly classified into the dry system developing method and wet system developing method. The former can further be classified into the method wherein two-component developer is used and the method wherein one-component developer is used.

As methods belonging to the two-component developing method, there are various methods distinguished according to the kind of the carrier for carrying the toner, such as the magnetic brush method employing iron powder carrier, the cascade method employing beads carrier, etc. These are all excellent methods, giving relatively stable and good images, but on the other hand suffer commonly from the drawback inherent in a two-component developer that the qualities of the resultant image are changed as the deterioration of the carrier and the change in the mixing ratio of the toner to the carrier.

In order to circumvent these drawbacks, various developing methods have been proposed, employing one-component developer. Above all, a number of excellent methods employing a magnetic toner have been practically used. One developing method employing a magnetic one-component developer is the magnedry method using an electroconductive toner. This is stable with respect to development, but a problem is involved in transfer onto a material to be transfer printed such as so called plain paper.

On the other hand, as a method with good transfer characteristic using a magnetic toner of higher resistivity, Japanese Laid-open Patent Application No. 94140/1977 discloses a method in which dielectric polarization of toner particles is utilized or Japanese Laid-open Patent Application No. 31136/1978 discloses a method in which charge migration is effected through disturbance of a toner. However, some problems are involved in stability of development in both of these methods. Alternatively, as a new developing method proposed by the research group to which we belong, has developed a commercially accepted method, in which development is effected by permitting toner particles to jump onto latent images, as disclosed in Japanese Laid-open Patent Applications No. 42141/1979 and No. 18656/1980. This method comprises applying a magnetic toner in a very thin layer on a sleeve, followed by triboelectrification thereof, and placing the toner layer very near the electrostatic images under the action of a magnetic field, face to face but without contact, thereby effecting development. According to this method, by applying very thinly a magnetic toner on a sleeve, the chances of contact between the sleeve and the toner are increased to enable sufficient triboelectric charging. Also, by supporting the toner by a magnetic force and causing the magnet and the toner to move relatively to each other, toner particles are freed from mutually agglomerated state and at the same time placed under sufficient friction with the sleeve. Further, by supporting the toner with a magnetic force and effecting development by placing the toner face to face near the electrostatic images without contact, ground fog is effectively prevented. Because of these features, good qualities of image can be obtained.

The toner of the present invention is suitable for any of a series of developing methods as described above but is most suitable for the method, in which development is effect through jumping of toner particles onto latent images, as disclosed in Japanese Laid-open Patent Application No. 18656/1980.

The toner images obtained are suitable for pressure fixing by use of a rigid roll of normal temperature or heated to a relatively lower temperature, for example, 50° C. or lower.

The present invention is described in more detail by referring to the following Examples and Comparative Examples.

EXAMPLE 1

As a core material, 50 parts of Hiwax 200P (produced by Mitsui Sekiyu Kagaku K.K.), 50 parts of Paraffin wax 155 (produced by Nippon Seiro K.K.) and 60 parts of magnetite were melt blended and granulated by a spray drier. Then, by dry system classification, spherical particles with sizes of $9.1\mu \pm 4.5\mu$ were obtained.

On the other hand, 20.2 g of triethylamine was dissolved in 500 $cm^3$ of tetrahydrofuran and the solution was transferred into a 1-liter three-necked flask equipped with a reflux condenser, a dropping funnel and a stirrer, and 50 g of the granulated core material was dispersed under stirring into the solution for 10 minutes. In the dropping funnel, 20.9 g of isocrotonic acid chloride (synthesized from isocrotonic acid and thionyl chloride according to the method of M. B. Hocking, Can. J. Chem., 46,466 (1968)) was placed, and it was added dropwise to the above solution under stirring. After the reaction was carried out at room temperature for 10 minutes and subsequently at 35° C. for 30 minutes, the dispersed product was separated by filtration, washed with acetone and then with water and dried at room temperature in a vacuum drier for about 12 hours.

A solution of 20 g of perbenzoic acid dissolved in 500 $cm^3$ of chloroform was transferred into the above 1-liter three-necked flask and 45 g of the core material with a first wall formed thereon as described above was added and dispersed into the solution under stirring, and the solution was held at 0° C. for 24 hours. After an excess of 10% aqueous sodium hydroxide solution was added to the solution, the product was separated by filtration, washed with acetone and with water and dried in vacuo for 6 hours to form an epoxidized first wall.

On the other hand, 2 g of a copolymer of dimethylaminoethyl methacrylate (DM) and styrene (DM content: 10 wt. %) was dissolved in 200 $cm^3$ of dimethylformamide, and 40 g of the core material having the epoxidized first wall as described above was dispersed into the solution under stirring at 5000 r.p.m. by means of a homomixer for 4 minutes.

Subsequently, 66 $cm^3$ of water was added dropwise to precipitate the DM-styrene copolymer to form the second wall on the core material. The dispersed product obtained was separated by filtration, washed with water and stored at 45° C. for 24 hours, to obtain a capsule toner.

One gram of this toner was mixed with 9 g of iron powder (200 to 300 mesh) and subjected to measurement of the amount of triboelectric charge according to a known method. As the result, it was found to be $+22.0\ \mu c/g$.

Next, to 30 g of this toner was added 0.12 g of a hydrophobic colloidal silica (trade name EK 150, treated with trimethylmethoxy silane, produced by Nippon Silica Kogyo K.K.), followed by mixing, to obtain a developer. The amount of triboelectric charge was found to be 20.0 $\mu c/g$. The developer was then applied to a developing apparatus having a magnetic sleeve, and after development of latent image having negative electrostatic charge, the developed image was transferred to wood free paper. The paper having the image was passed through a pressure fixing instrument comprising a pair of pressure rollers arranged to apply a pressing force from the both faces, whereby substantially complete fixing performance was attained at a speed of 125 mm/sec. under a line pressure of 10 kg/cm. The image density was 1.3, and the reversed image formed was good and clear without fog.

Further, in the developing apparatus, after 4 hours' blank rotation continued for durability test, development and transfer were conducted again. As the result, the resultant image density was 1.5 and the amount of triboelectric charges was 20.5 μc/g, without change in image quality, thus indicating good durability. Also, when the toner surface was observed by an electron microscope, no peel-off of the wall was found at all.

EXAMPLE 2

Paraffin (m.p. 155° C.)—70 parts
Carnauba wax—15 parts
Ethylene-vinyl acetate resin—15 parts
Magnetic material—60 parts A blend having the above composition was melted and kneaded to prepare a mixture having the magnetic material well dispersed therein, which was then sprayed to obtain a core material with particle sizes of 5 to 20μ (mean particle size of 10.2μ). This core material (100 g) was dispersed in an aqueous polyvinyl alcohol solution having the following composition.

Polyvinyl alcohol (Saponification degree 98–100%, polymerization degree 1700)—10 g
Surfactant—0.5 g
Water—1000 g While maintaining the temperature at 45° to 50° C., an aqueous saturated ammonium sulfate solution was added dropwise under stirring into the polyvinyl alcohol solution containing the core material dispersed therein. The dropwise addition was discontinued when the viscosity of the solution was elevated once and lowered again, and then with addition of an amount exceeding the saturation of ammonium sulfate, the mixture was rapidly heated up to a temperature of 150° C., and maintained at this temperature for 10 minutes. This step was followed by filtration, washing with cold water and drying to obtain a microcapsule having a core of paraffin/carnauba wax/ethylene-vinyl acetate copolymer/magnetic material and a capsule wall of polyvinyl alcohol.

This microcapsule (100 g) was dispersed in a second capsule wall material solution having the following composition:

Vinylidene chloride-acrylonitrile copolymer—3 g
DMF (dimethylformamide)—300 ml, and water was added dropwise under stirring to the resultant dispersion to effect phase separation of the vinylidene chloride-acrylonitrile copolymer, thereby causing the coacervate formed to enclose the microcapsules. Then, water was further added continuously to dehydrate the coacervate and harden the vinylidene chloride-acrylonitrile copolymer layer to obtain a microcapsule magnetic toner comprising a core material of paraffin/carnauba wax/ethylene-vinyl acetate copolymer/magnetic material coated successively with a capsule wall of polyvinyl alcohol and with a further capsule wall of vinylidene chloride-acrylo-nitrile copolymer.

This magnetic toner, when mixed in an amount of 10 wt.% with iron oxide carrier and subjected to measurement of the amount of triboelectric charges in a conventional manner, was found to exhibit a high negatively charging characteristic of −22 μ/g. When this magnetic toner was applied to a copying machine NP-120 (produced by Canon K.K.) employing a pressure fixing system, very clear images were obtained. An unfixed image was taken out and its fixing pressure was measured by passing through a fixing instrument separately provided and set at a predetermined pressure. As the result, at the line pressure of 12 kg/cm, there occurred no such inconvenience as lustering of the fixed image or warping of the fixed paper. With the use of this magnetic toner, continuous copying was carried out by means of the NP-120 machine, whereby the image density was maintained from the initial stage at 1.5 ±0.1, and on copying of 50,000 sheets, the image quality was good without any fusion or agglomeration of the toner in the developing instrument.

Also, when this magnetic toner was stored at 60° C. for one month, no deterioration of performance was observed at all.

Comparative Example 1

The core material of Example 2 exhibited a fixing line pressure of 10 kg/cm as such, but it caused excessive agglomeration and therefore was not suitable for development. Then, microencapsulation was repeated in the same manner as in Example 2, except that no polyvinyl alcohol layer was provided. The magnetic toner obtained was subjected to measurement of triboelectric charges similarly as in Example 2 to exhibit −16 μ/g. When this magnetic toner was applied to the NP-120 machine, the resultant image density was 1.2 ±0.1, which was gradually lowered with successive copying, until it was lowered down to below 0.5 on copying of 10,000 sheets.

When this magnetic toner was left to stand at 60° for 3 days, the resultant image density was lowered to 0.5.

EXAMPLE 3

2,2-Bis(4'-glycidyloxyphenyl) propane—50 mol%
Fumaric acid—47 mol %
Trimellitic Acid—3 mol %

A blend of 100 parts of a polyester (Mw =60,000, Mw/Mn = 12; Mw: weight-average molecular weight, Mn: number-average molecular weight) having the above composition with 5 parts of carbon black was melt and kneaded, followed by crushing, to obtain colored fine particles of 3 to 20 μ (mean particle diameter: 8.2 μ).

The colored fine particles as the core material was dispersed in an aqueous polyvinyl alcohol solution in such a proportion as to give a core material/wall material ratio of 12/1 and, similarly as in Example 2, microcapsules with a polyvinyl alcohol wall containing the colored polyester were obtained.

These microcapsules (100 g) were dispersed in a solution of a second wall material having the following composition:

Styrene-N, N-dimethylaminoethyl meth- acrylate copolymer—5 g
MEK (methyl ethyl ketone)—300 ml.

To the dispersion, n-octane was added dropwise to effect phase separation of the styrene-N,N-dimethylamino methacrylate copolymer, thereby causing the resultant coacervate to enclose the microcapsule. Then, MEK was evaporated off by heating the encapsulation bath to a temperature of 40° C. to harden the styrene-N,N-dimethylaminoethyl methacrylate copolymer layer, followed by filtration and drying, thereby obtaining a microencapsulated toner having the core of carbon black/polyester coated successively with a capsule wall of the polyvinyl alcohol and with a capsule wall of the styrene-N,N-dimethylaminoethyl methacrylate.

This microcapsule toner was subjected to measurement of triboelectric charges in a conventional manner as a mixture of 10 wt. % thereof with iron oxide powdery carrier to exhibit a high positive charging characteristic of +26 μ/g. This microcapsule toner was applied to a copying machine, model NP-8500 super (produced by Canon K.K.) using a two-component developing system to obtain a very clear and highly contrasted image. When the fixing temperature of this microcapsule toner was measured by means of a heat roll fixing instrument (line pressure: 2 kg/cm) comprising a silicone rubber roller and a Teflon roller, fixing could be effected at 130° C., with no off-set phenomenon observed at all oven at a temperature higher than 200° C.

Comparative Example 2

The core material above of Example 3 had a fixing temperature of 130° C. and a heat off-set resistance of 200° C. or higher, but exhibited a weak negative charging characteristic, having substantially no triboelectric charge under a highly humid environment. Then, microencapsulation was performed according to the same procedure as in Example 3 except for providing no polyvinyl alcohol layer. The resultant microcapsule toner was found to have an amount of triboelectric charge of +22 μ/g as measured in the same manner as in Example 3.

The microcapsule toner was applied to the NP- 8500 machine. As the result, the image was fair in density but with much background fog. When image formation was conducted continuously, background fog became markedly greater on copying of about more than 10,000 sheets, simultaneously with contamination with white fine powder around the developing instrument. The fine powder was found to have the same composition as the styrene-N,N-dimethylaminoethyl methacrylate copolymer as the wall material.

The image density obtained by using the capsule toner was also lowered to 40% or less of that under normal temperature and normal humidity, when placed under a high humidity environment of 85% RH at 35° C.

EXAMPLE 4

After 50 parts of AC polyethylene 1702 (produced by Allied Chemicals Corp.) were suspended in 200 ml of DMF (dimethylformamide) by means of an automatic homomixer (produced by Tokushu Kika Kogyo K.K.), 100 cc of water was added to the resultant dispersion. The suspension obtained was placed in a liquid cell with an interelectrode distance of 5 mm and an electrode surface area of 10 $cm^2$, and a direct current voltage of 300 volt was applied for one minute, whereby the polyethylene was found to be electrodeposited on the ⊕ electrode. From this fact, the polyethylene was found to be negatively charged.

When 100 ml of deionized water was added dropwise with a burette to a solution of 5 g of a copolymer of styrene-dimethylaminoethyl methacrylate copolymer (polymerization ratio: 95:5, Mw = 12,000) dissolved in 200 ml of DMF, phase separation occurred to give styrene-dimethylaminoethyl methacrylate coacervate droplets. The dispersion of the coacervate droplets was placed in the above liquid cell and applied with 300 volt for one minute. As the result, the coacervate droplets were deposited on the ⊖ electrode, indicating that the coacervate droplets were positively charged.

Into a solution of 5 g of polyvinyl butyral (Eslec B produced by Sekisui Kafaku K.K.) in 200 ml of ethanol, 150 ml of water was added dropwise from a burette to cause phase separation to form coacervate droplets of the polyvinyl butyral. The dispersion of the coacervate droplets were placed in the above liquid cell and applied with 300 V for one minute. As the result, the coacervate droplets were deposited onto the ⊕ electrode, indicating that the coacervate droplets were negatively charged.

Next, 50 g of AC polyethylene (produced by Allied Chemicals) was dispersed into a 2 wt.% solution of a 95:5 styrene-dimethylaminoethyl methacrylate copolymer in DMF by means of an automatic homomixer to obtain a dispersion of polyethylene particles with a mean particle size of 20 μ. While continuing stirring by the automatic mixer kept at a rotational speed of 7000 rpm, 100 ml of deionized water was added from a burette at a rate of 10 ml/min. After filtration and removal of the medium of the solvent mixture of DMF and water, the product was dried in a drier at 30° C. for 24 hours to give a microcapsule with the polyethylene as the core material having a wall of styrene-dimethylaminoethyl methacrylate.

Subsequently, 50 g of the thus obtained microcapsule was dispersed in a 2.5 wt.% polyvinyl butyral solution in 200 ml of ethanol while using an automatic homomixer. Into the dispersion, 150 ml of deionized water was added dropwise at a rate of 3 ml/min. with a burette. After the removal of a mixture of ethanol and water, the product was dried at 45° C. in a drier to obtain a double-wall microcapsule toner comprising a core of polystyrene, a first wall of styrene-dimethylaminoethyl methacrylate copolymer and a second wall of polyvinyl butyral.

Comparative Example 3

Encapsulation was carried out according to a manner as described in Example 4, except for using a styrene polymer with Mw = 12,000 in place of the styrene-dimethylaminoethyl methacrylate copolymer, whereby a single wall microcapsule toner comprising a core of the polyethylene and a wall of styrene polymer.

The coacervate droplets of this styrene polymer were found to be negatively charged, since they were electrodeposited on the positive electrode by application of a direct current voltage of 300 volt for one minutes. The intermediate single-wall capsule powder of Reference Example 1 and the single-wall capsule powder of Comparative Example 3 were respectively placed in amount of 50 cc in a beaker and left to stand in a drier at 60° C. for one week. As the result, the powder of Reference Example 1 was found to maintain the original powdery state, but that of Comparative Example 3 had been agglomerated.

Electron microscope observation of the singlewall capsules of Example 4 and Comparative Example 3 subsequently conducted gave the results that the capsules of Example 4 has smooth capsule surfaces without free wall-forming resin, while those of Comparative Example 3 had numerous small adherents attached on the capsule wall surface, indicating presence of free wall-forming resin.

EXAMPLE 5

Elbamide (Nylon soluble in alcohol, produced by Du Pont, Inc.) melted by heating in a flask equipped with a reflux condenser was quenched into ethanol to provide a dispersion of nylon spheres of a mean particle size of 20 μ dispersed in ethanol. The dispersion was filtered and dried to recover the nylon as pwder of 20 μ.

To a dispersion of 50 g of the above nylon particles dispersed in 200 ml of DMF by means of an automatic homomixer, 100 ml of water was added. The suspension was electrodeposited similarly as in Example 4 by use of a liquid cell to find that the nylon particles were positively charged.

To a solution of 5 g of Saran (vinylidene chloride-acrylonitrile copolymer produced by Asahi- Dow K.K.) in 200 ml of DMF was added 100 ml of deonized water from a burette, whereby the coacervate droplets of Saran were formed as the result of phase separation.

The dispersion of the coacervate droplets was placed in a liquid cell and applied with a direct current of 300 volt for one minute, whereby the coacervate droplets were deposited onto the positive electrode, indicating that the coacervate droplets were negatively charged.

Next, 50 g of the nylon spheres were dispersed into a 2.5 wt.% DMF solution of Saran by means of an automatic homomixer, and 100 ml of deionized water was added dropwise at a rate of 10 ml/min. by use of a burette, while continuing stirring of the homomixer at 5000 r.p.m. Then, the product was filtered, and the encapsulation medium of a solvent mixture of DMF and water was removed, followed by drying in a drier at 30° C. for 24 hours, to obtain microcapsules containing nylon as the core material enclosed within walls of Saran.

Comparative Example 4

In place of Saran of Example 5, the styrene-dimethylaminoethyl methacrylate copolymer (the same as in Example 4) was employed, following otherwise a similar procedure as described in Example 5, to carry out encapsulation. The surfaces of the single-wall capsules of Example 5 and Comparative Example 4 were observed by an electron microscope to find that the capsules of Example 5 had a smooth surface, while those of Comparative Example 4 had a number of small adherents on the capsule surface.

What is claimed is:

1. A microcapsule toner for developing electrostatic or magnetic latent images, comprising a colored solid core material containing a binder resin, a first resin wall coating said core material and a second resin wall coating said first resin wall, wherein said first and second resin walls have been prepared through phase separation, and said first resin wall has a charging characteristic to a polarity opposite to those of said core material and said second wall resin in encapsulating media for formation of said first resin wall and for formation of said second resin wall, respectively.

2. The microcapsule toner according to claim 1 wherein the binder resin is polyolefin or paraffin wax.

3. A microcapsule toner for developing electrostatic or magnetic latent images, comprising a colored solid core material containing a binder resin and a resin wall coating said core material in which said core material is chemically bonded to said resin wall by having been produced through the steps of reacting an olefinic carboxylic acid chloride with a colored core material containing a binder resin in the presence of an acid eliminating agent, epoxidizing the resultant core material having an olefinic unit to obtain a core material having epoxy unit at the surface thereof,and encapsulating the obtained core material with a resin having a tertiary amine unit; said core material being solid at room temperature.

4. The microcapsule toner according to claim 3, wherein the binder is polyolefin or paraffin wax.

5. A microcapsule toner for developing electrostatic or magnetic latent images, comprising a colored solid core material containing a binder resin, a first resin wall of polyvinyl alcohol coating said core material and a second resin wall coating said first resin wall, said microcapsule toner being produced by dispersing a colored core material containing a binder resin in an aqueous polyvinyl alcohol solution; precipitating polyvinyl alcohol on the surface of the core material by addition of an inorganic salt to obtain an encapsulated core material with a first resin wall of polyvinyl alcohol; and encapsulating the encapsulated core material with a second resin wall for imparting developing characteristic.

6. The microcapsule toner according to claim 5, wherein the binder resin is polyolefin or paraffin wax.

7. A process for producing a microcapsule toner for developing electrostatic or magnetic latent images, comprising:

dispersing a colored solid core material containing a binder resin in a solution of a capsule wall-forming resin in dimethylformamide, adding water to the resultant dispersion under agitation thereby to cause phase separation of said capsule wall-forming resin, and forming a capsule wall of said capsule wall-forming resin around said solid core material;

said capsule wall-forming resin having a charging polarity opposite to that of said solid core material in the mixture of dimethylformamide and water.

8. The process according to claim 7, wherein said binder resin of the solid core material comprises polyolefin or paraffin wax.

9. The process according to claim 7 wherein said capsule wall-forming resin comprises a copolymer of styrene and dimethylaminoethyl methacrylate.

* * * * *

UNITED STATES PATENT AND TRADEMARK OFFICE

CERTIFICATE OF CORRECTION

PATENT NO. : 4,565,764

DATED : January 21, 1986

INVENTOR(S) : Toshiaki Nakahara, et al.

It is certified that error appears in the above-identified patent and that said Letters Patent is hereby corrected as shown below:

Column 1, line 12, "electrostatography," should be --electrophotography,--.
Column 1, line 36, "thus" should be --Since--.
Column 1, line 38, after "sheets," insert --is avoided--.
Column 1, line 44, "discloed" should be --disclosed--.
Column 2, line 7, "such as component" should be --such a component--.
Column 2, line 30, "characteristics" should be --characteristic--.
Column 3, line 46, "preferably" should be --preferable--.
Column 5, line 33, "carboxilic" should be --carboxylic--.
Column 6, line 44, "to ther" should be --to other--.
Column 6, line 60, "saponificion" should be --saponification--.
Column 7, line 47, "olefins resins" should be --olefin resins--.
Column 9, line 64, "is effect" should be --is effected--.
Column 10, line 68, "wood free" should be --wood-free--.
Column 11, line 64, "acrylo-nitrile" should be --acrylonitrile--.
Column 12, line 59, "meth-acrylate" should be --methacrylate--.
Column 13, line 19, "oven" should be --even--.
Column 14, line 52, "one minutes." should be --one minute.--.
Column 14, line 61, "singlewall" should be --single-wall--.
Column 14, line 64, "has" should be --had--.
Column 15, line 7, "pwder" should be --powder--.
Column 15, line 15, "Asahi- Dow" should be --Asahi-Dow--.
Column 15, line 16, "deonized" should be --deionized--.

UNITED STATES PATENT AND TRADEMARK OFFICE

CERTIFICATE OF CORRECTION

PATENT NO. : 4,565,764

DATED : January 21, 1986 Page 2 of 2

INVENTOR(S) : Toshiaki Nakahara, et al.

It is certified that error appears in the above-identified patent and that said Letters Patent is hereby corrected as shown below:

Column 16, lines 33-34, "characteris-tic" should be --characteristics.--

Signed and Sealed this

Sixth Day of January, 1987

*Attest:*

DONALD J. QUIGG

*Attesting Officer*

*Commissioner of Patents and Trademarks*